US005833451A

United States Patent [19]

McMillan

[11] Patent Number: 5,833,451

[45] Date of Patent: Nov. 10, 1998

[54] PREMIX BURNER

[75] Inventor: Robin McMillan, Untersiggenthal, Switzerland

[73] Assignee: Asea Brown Boveri AG, Baden, Switzerland

[21] Appl. No.: 746,139

[22] Filed: Nov. 6, 1996

[30] Foreign Application Priority Data

Dec. 5, 1995 [DE] Germany ..... 195 45 309.3

[51] Int. Cl.[6] ..... F23D 14/46

[52] U.S. Cl. ..... 431/350; 431/189; 431/351

[58] Field of Search ..... 431/189, 350–354, 431/9, 10, 182, 188, 285, 278, 185; 60/737, 743, 749

[56] References Cited

U.S. PATENT DOCUMENTS

| | | | |
|---|---|---|---|
| 4,988,287 | 1/1991 | Stegelman et al. | 431/351 |
| 5,118,283 | 6/1992 | Sattelmayer | 431/351 |
| 5,240,409 | 8/1993 | Xiong | 431/189 |
| 5,487,659 | 1/1996 | Eroglu | 431/350 |
| 5,588,826 | 12/1996 | Dobbeling et al. | 431/351 |

FOREIGN PATENT DOCUMENTS

| | | |
|---|---|---|
| 0321809B1 | 5/1991 | European Pat. Off. . |
| 1451393 | 3/1969 | Germany . |
| 3424031A1 | 1/1986 | Germany . |

OTHER PUBLICATIONS

"Umstellung eines Huttenwerkes auf Erdgasbetrieb unter besonderer Berucksichtigung der betrieblichen Massnahmen", Von Helmut Klammer, Stahl u. Eisen 86, No. 3, Feb. 10, 1966, pp.142–149.

*Primary Examiner*—James C. Yeung

*Attorney, Agent, or Firm*—Burns, Doane, Swecker & Mathis, L.L.P.

[57] ABSTRACT

A premix burner (1) essentially comprises at least two sectional cone bodies (12, 13) which are nested one inside the other in the direction of flow and the respective cone axes of which are offset relative to a center axis (10). Tangential slots (16) are thereby formed for the combustion air (9). Starting from the tip of the sectional cone bodies (12, 13), a feed lance (1) is arranged which extends downstream into the interior of the premix burner (11) and runs essentially symmetrically to the center axis (10). At least one fuel nozzle (8) is arranged at the downstream end of the feed lance (1).

9 Claims, 3 Drawing Sheets

PREMIX BURNER

BACKGROUND OF THE INVENTION

1. Field of the Invention

The invention relates to a premix burner, essentially comprising at least two sectional cone bodies which are nested one inside the other in the direction of flow and the respective cone axes of which are offset relative to a center axis, as a result of which tangential slots are formed for the combustion air.

2. Discussion of Background

Such premix burners have been disclosed, for example, by U.S. Pat. No. 4,932,861 to Keller et al. The combustion air is set in rotation by the premix burner, which is designed as a swirl burner and comprises two conical half shells. The fuel is blown into the rotating air and mixed with it there. A defined, calotte-shaped recirculation zone forms at the burner outlet. At the tip of the recirculation zone ignition takes place. The flame itself is stabilized by the recirculation zone in front of the burner without the need for a mechanical flame retention baffle. The thermoacoustic behavior of such burners is normally stable and they are distinguished by a simple and cost-effective construction.

If the burner is operated with gaseous fuel, gas-inflow openings distributed in the longitudinal direction in the walls of the two sectional bodies are provided for this purpose in the region of the tangential slots formed by the two conical half shells. In gas operation, mixture formation with the combustion air therefore already starts in the zone of the inlet slots.

A fuel nozzle for liquid fuel is arranged at the tip of the conical half shells. The fuel is injected at an acute angle into the hollow cones. The resulting conical fuel profile is enclosed by the tangentially inflowing air. The concentration of the fuel is continuously reduced in the axial direction as a result of the mixing with the inflowing air. In this case, the injection angle of the fuel is determined by the opening angle of the premix burner. However, good mixing between liquid and gaseous fuel is made more difficult by the small opening angle, a factor which may lead to increased pollutant emission.

At part load, when the operation of the premix burner is no longer guaranteed by the injection of gaseous fuel in the region of the tangential slots, gaseous fuel is injected via the fuel nozzle arranged at the tip of the conical half shells. Due to the large axial distance between backflow zone and fuel nozzle, however, there is a risk of the axial position of the flame changing and of pulsations occurring as a result. Furthermore, due to the large axial distance between backflow zone and fuel nozzle, the quantity of fuel required increases, which may lead to increased pollutant emission.

SUMMARY OF THE INVENTION

Accordingly, one object of the invention, in a premix burner of the type mentioned at the beginning, is to reduce the pollutant emission and to stabilize the backflow zone.

According to the invention, this is achieved in that, starting from the tip of the sectional cone bodies, a feed lance is arranged which extends downstream into the interior of the premix burner and positioned symmetrically about the center axis, and in that at least one fuel nozzle is arranged at the downstream end of the feed lance.

The advantages of the invention may be seen, inter alia, in the fact that the axial distance between backflow zone and fuel nozzle is shortened by the feed lance projecting into the burner interior. The backflow zone is thereby stabilized in the axial direction in each load range and pulsations are avoided. In addition, by the injection of the fuel through the fuel nozzle being effected near the backflow zone, less fuel is required to stabilize the flame. It is therefore also possible during part-load operation to operate the premix burner with low nitrogen-oxide emission. In addition, the outer surface of the feed lance serves as a shearing area, which assists the intermixing of gaseous fuel and combustion air and thus reduces the pollutant emission. The injection angle of the fuel nozzle for liquid fuel can be increased by positioning the fuel nozzle near the backflow zone. The premixing when using liquid fuels is thereby improved and the nitrogen-oxide emission is reduced.

It is especially expedient if the feed lance extends downstream at least right into the bottom third of the premix burner. This prevents backfire of the flame front into the burner interior.

Furthermore, it is expedient to form the feed lance from a lance tube and a fuel line arranged therein. Some of the combustion air can thereby be blown in through the lance tube, as a result of which the intermixing of fuel and air is assisted. In addition, the flame is prevented from settling on the end of the feed lance.

It is advantageous to arrange a swirl body between the lance tube and the fuel line. Any swirl can thereby be imposed on the air blown in through the lance tube, as a result of which the intermixing is further optimized.

In addition, it is expedient to arrange an airblast atomizer at the downstream end of the lance tube. This enables liquid fuel to be burnt with low pollutant emissions.

It is of advantage for the premix burner to have a circular cross-section at least in the region of the burner outlet. The circular burner outlet produces an axially symmetrical flow relative to the center axis. Pulsations, caused by the sectional cone axes, are thereby avoided and the backflow zone is further stabilized.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
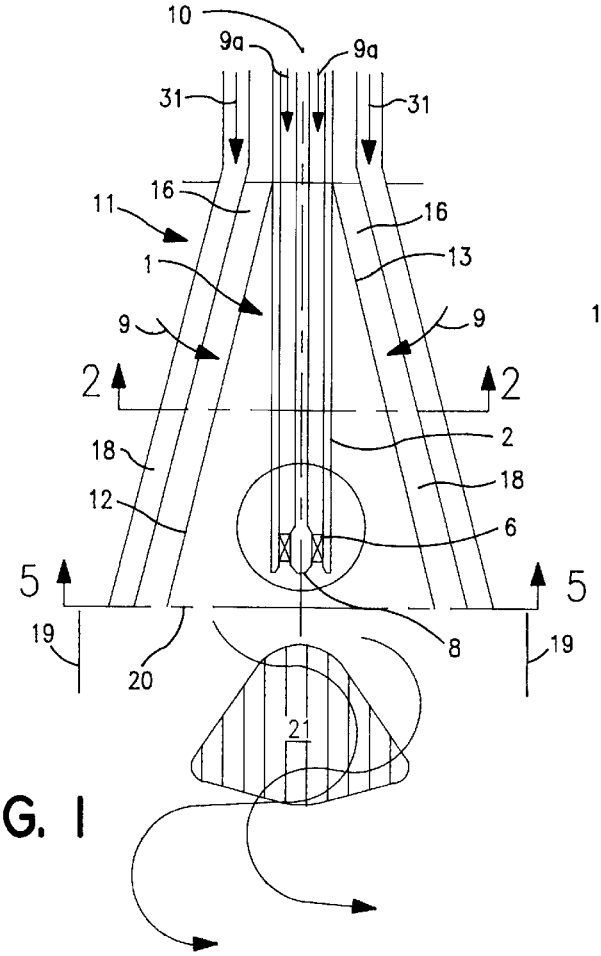
FIG. 1 shows a partial longitudinal section through the premix burner.
Figure 2:
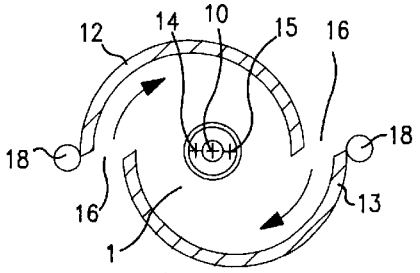
FIG. 2 shows a partial cross-section through the premix burner along line II—II in FIG. 1.

Referring now to the drawings, wherein like reference numerals designate identical or corresponding parts throughout the several views, only the elements essential for understanding the invention are shown, and the directions of flow of the working media are reproduced by arrows, in FIGS. 1 and 2 a premix burner 11 is shown schematically. The premix burner 11 is essentially a so-called double-cone burner as disclosed by U.S. Pat. No. 4,932,861 to Keller et al. mentioned at the beginning. The premix burner is used to mix combustion air and fuel prior to combustion, for example in a gas-turbine group. Such a premix burner 11 consists of two hollow, semi-conical sectional bodies 12 and 13 which are nested one inside the other in the direction of flow. In this arrangement, the respective cone axes 14 and 15 of the two sectional bodies are offset relative to the center axis 10 of the premix burner 11. The adjacent walls of the two sectional bodies form in their longitudinal extent slots 16 for the compressed combustion air 9, which passes tangentially into the burner interior.

Gas-feed lines 18 extending in the longitudinal direction are provided on the walls of the two sectional bodies in the region of the tangential inlet slots 16. The injection of the gaseous fuel is effected via gas-inflow openings (not shown) branching off from the gas-feed line 18.

A feed lance 1 extending downstream is arranged symmetrically about the center axis 10 of the premix burner 11 starting from the tip formed by the sectional cone bodies 12, 13. The feed lance 1 consists of a lance tube 2 and a fuel line 3 arranged therein. In this arrangement, the axial position of the downstream end of the feed lance 1 lies preferably at least in the bottom third of the premix burner 11, i.e. the feed lance may also project from the premix burner 11. For example, the feed lance 1 may project from the premix burner 11 by up to twenty percent of the axial height of the premix burner. A swirl body 6 is arranged in the interior of the lance tube 2, preferably near the downstream end.

Figure 3:
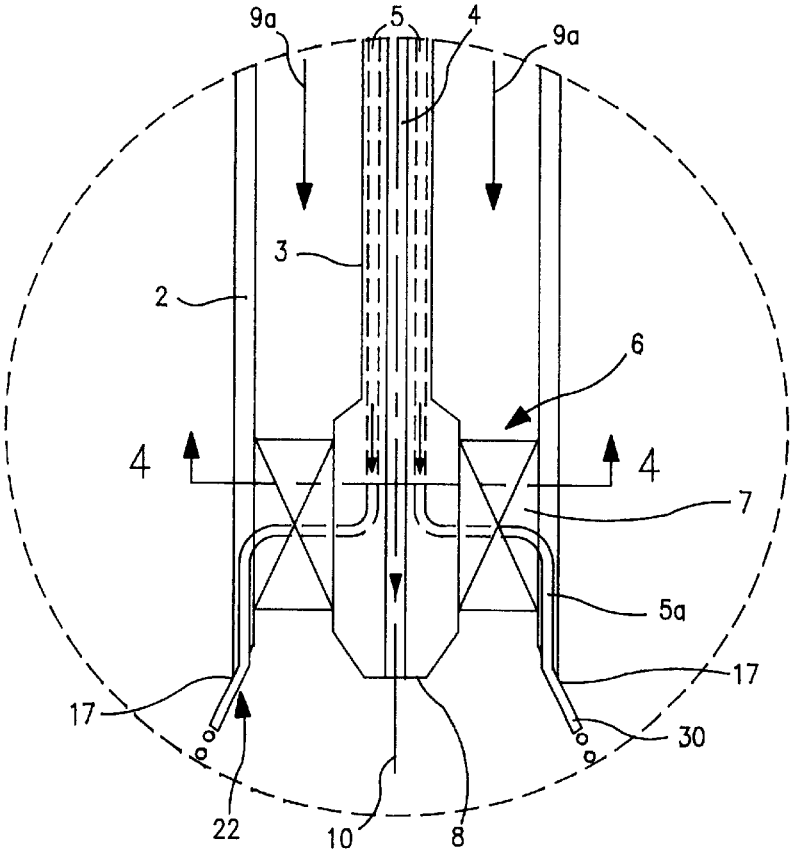
FIG. 3 shows the detail III from FIG. 1.
Figure 4:
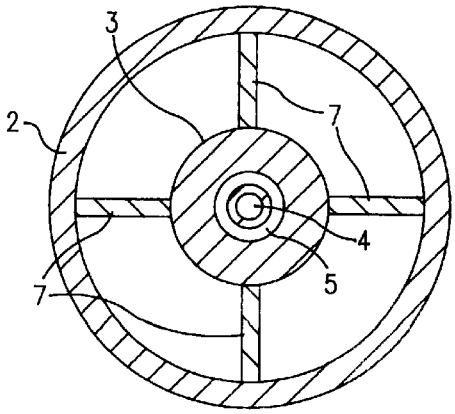
FIG. 4 shows a partial cross-section along line IV—IV in FIG. 3.

According to FIG. 3 and FIG. 4, the swirl body 6 consists of a plurality of baffle bodies 7 which are arranged between the inner wall of the lance tube and the fuel line 3. An annular outer fuel-feed passage 5 and an inner fuel-feed passage 4 are arranged in the interior of the fuel line 3. Fuel is fed by means of the inner passage 4 to a fuel nozzle 8 located at the downstream end of the fuel line 3. This nozzle 8 is designed as a dual nozzle for injecting liquid and gaseous fuels. The outer passage 5 branches off via the baffle bodies 7 into an outer fuel-feed passage 5*a* in the interior of the downstream end of the lance tube 2. The liquid fuel 30 delivered through the outer passage 5 is thereby passed to the downstream end of the lance tube 2. The lance-tube outer edge situated at the downstream end of the lance tube 2 serves as atomizing edge 17.

The compressed combustion air 9 produced in a compressor (not shown) enters the interior of the premix burner 11 via the tangential inlet slots 16. The air 9 is set in rotation by the configuration of the premix burner 11, the swirl coefficient increasing in the direction of flow. During gas operation, the mixture formation with the combustion air 9 starts in the zone of the inlet slots 16. The outer wall of the lance tube 2 serves as additional shearing area, which further assists the intermixing of combustion air 9 and gaseous fuel. As homogeneous a fuel concentration as possible over the cross-section acted upon appears at the burner outlet 20. A defined, calotte-shaped backflow zone 21, at the tip of which ignition takes place, develops at the burner outlet 20 in the combustion chamber formed by a combustion-chamber wall 19. The axial position of the backflow zone 21 is fixed by the axial position of the downstream end of the feed lance 1. The backflow zone is thereby prevented from being axially displaced and thus from pulsating.

At part load, when the operation of the premix burner 11 is no longer guaranteed by the injection of gaseous fuel 31 in the region of the tangential slots 16, gaseous fuel is injected via the nozzle 8. The gaseous fuel is thereby injected near the backflow zone 21, as a result of which pulsations between full-load and part-load operation are avoided. Furthermore, the required quantity of fuel which has to be injected through the nozzle 8 is reduced, since the fuel is injected directly into the backflow zone 21.

Combustion air 9*a* is likewise delivered through the hollow space between lance tube 2 and fuel line 3. In this case, the combustion-air portion 9*a* delivered through the lance tube may be up to 25% of the total air flow. The combustion air 9*a* is set in rotation by the swirl body 6. Here, the type and intensity of the swirl must be adapted to the respective conditions of the premix burner. Thus the swirl body 6, for example, can be designed so that the swirl generated by it runs in opposition to the swirl of the premix burner 11. This increases the intermixing of combustion air 9, 9*a* and fuel and additionally prevents the backfire of the backflow zone 21 and thus of the flame at the downstream end of the feed lance 1.

If the premix burner 11 is operated with liquid fuel, the fuel is injected by means of the feed lance 1. This is effected by means of the outer passage 5, via which liquid fuel 30 is delivered to the atomizing edge 17. An airblast atomizer 22 is thereby formed by means of the air 9*a* delivered through the lance tube 2. To improve the atomization, the air 9*a* may possibly have to be further compressed relative to the air 9.

Furthermore, liquid fuel can be injected via the fuel nozzle 8. The spray angle of the nozzle 8 can be selected to be very large on account of the axial position of the nozzle 8 in the interior of the premix burner 11. The intermixing of air 9, 9*a* and fuel is thereby improved.

Figure 5:
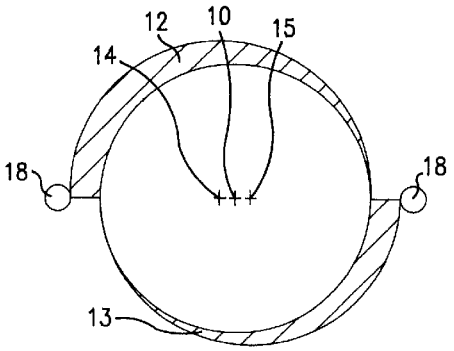
FIG. 5 shows a partial cross-section through the premix burner along line V—V in FIG. 1.

According to FIG. 5, the premix burner may be equipped with a circular outlet at least at the burner outlet 20. To this end, the two axes 14, 15 of the sectional cone bodies 12, 13 must be brought together, for example on the center axis 10. The backflow zone 21 is further stabilized and pulsations are avoided by the circular outlet.

Figure 6:
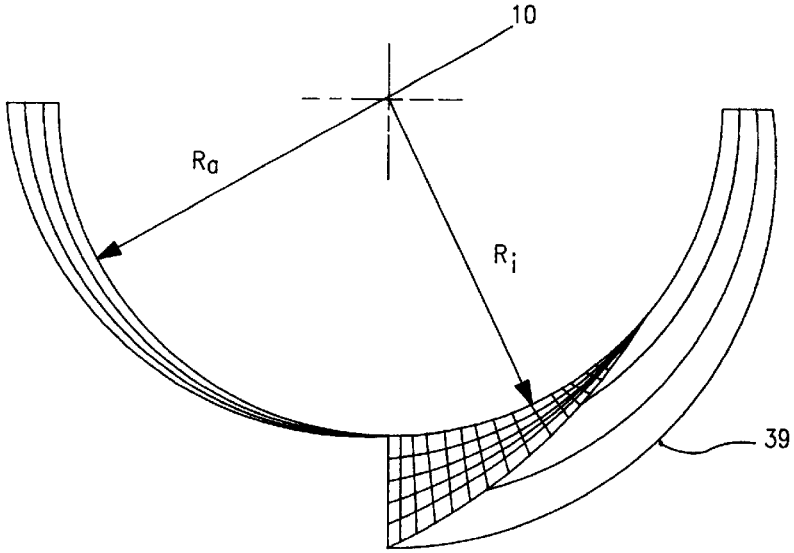
FIG. 6 shows a partial cross-section of an adaptor.
Figure 7:
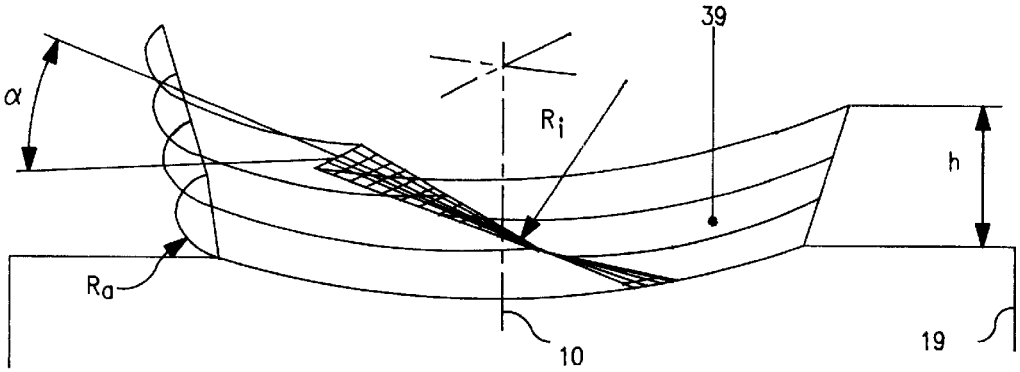
FIG. 7 shows a schematic, perspective representation of the adaptor.

According to FIG. 6 and FIG. 7, an adaptor 39 may be attached to the downstream end of the premix burner 11 in order to convert the cross-section of the premix burner 11 into a circular cross-section. In this case, the inner radius $R_i$ of the two sectional cone bodies 12, 13 at the transition to the adaptor 39 is greater than the outlet radius $R_a$ of the adaptor 39. The height h and the size of the angle $\alpha$ of the adaptor 39 depend on the shape of the inlet into the adaptor 39. The angle $\alpha$ corresponds to the average flow angle so that no separation can occur. The free area of the adaptor 39 through which flow can occur decreases in the direction from the inlet up to the outlet of the adaptor 39; therefore the flow is additionally accelerated here by the adaptor.

The invention is of course not restricted to the exemplary embodiment shown and described. The premix burner may of course be provided with a plurality of tangential inlet slots. The feed lance may also be fitted into premix burners different to the double-cone burner. The dual nozzle may also be composed of two nozzles, in which case the inner feed passage has to be appropriately adapted. The outer fuel-feed passage may also be shifted from the fuel line into the lance tube.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A premix burner, comprising:

at least two sectional cone bodies mounted to define a conical interior space extending from a narrow inlet end downstream to an outlet, respective longitudinal axes of the bodies being laterally offset relative to a center axis of the interior space, so that adjacent edges of the bodies are mutually spaced to provide longitudinally extending inlet slots for a tangentially directed inflow of combustion air into the interior space, a feed lance mounted to extend through the interior space in the longitudinal direction from the inlet end of the interior space and positioned symmetrically about the center axis, the feed lance extending to at least a downstream third of the premix burner, and at least one fuel nozzle disposed at a downstream end of the feed lance.

2. The premix burner as claimed in claim 1, wherein the feed lance comprises a lance tube and a fuel line arranged therein, and wherein the fuel nozzle is disposed at a downstream end of the fuel line.

3. The premix burner as claimed in claim 1, wherein the fuel line includes an inner fuel-feed passage and an outer fuel-feed passage.

4. The premix burner as claimed in claim 3, further comprising an airblast atomizer disposed at the downstream end of the lance tube.

5. The premix burner as claimed in claim 3, further comprising a swirl body disposed between the lance tube and the fuel line.

6. The premix burner as claimed in claim 3, wherein the swirl body consists of a plurality of baffle bodies.

7. The premix burner as claimed in claim 6, wherein the premix burner has a circular cross-section at least in a region of the burner outlet.

8. The premix burner as claimed in claim 1, further comprising an adaptor mounted at the downstream end of the premix burner the adaptor having a circular cross-section at a downstream end.

9. The premix burner as claimed in claim 1, wherein an inner radius (Ri) of the two sectional cone bodies of the premix burner at a transition to the adaptor is greater than an outlet radius (Ra) of the adaptor.

* * * * *